US008709334B2

(12) United States Patent
Lu

(10) Patent No.: US 8,709,334 B2
(45) Date of Patent: Apr. 29, 2014

(54) METAL MELTING APPARATUS AND METHOD FOR MELTING METAL

(75) Inventor: Shao-Hua Lu, Taoyuan County (TW)

(73) Assignee: Pinda Technology Co., Ltd., Daxi Township, Taoyuan County (TW)

( * ) Notice: Subject to any disclaimer, the term of this patent is extended or adjusted under 35 U.S.C. 154(b) by 324 days.

(21) Appl. No.: 13/337,933

(22) Filed: Dec. 27, 2011

(65) Prior Publication Data

US 2013/0161881 A1 Jun. 27, 2013

(51) Int. Cl.
*C22B 9/00* (2006.01)

(52) U.S. Cl.
USPC ..... 266/44; 266/242; 266/901

(58) Field of Classification Search
CPC ..... C22B 7/003; C22B 9/00; F27D 3/08; F27D 13/00; F27D 27/00
USPC ..... 266/44, 216, 242, 275, 901, 900; 432/262
See application file for complete search history.

(56) References Cited

U.S. PATENT DOCUMENTS

| | | | | | |
|---|---|---|---|---|---|
| 2,224,081 | A | * | 12/1940 | Jung | 266/88 |
| 2,472,465 | A | * | 6/1949 | Cornell | 266/242 |
| 2,793,852 | A | * | 5/1957 | Harrison | 266/242 |
| 3,667,745 | A | * | 6/1972 | Lazaridis | 266/141 |
| 3,860,223 | A | * | 1/1975 | Berger | 266/144 |
| 4,605,438 | A | * | 8/1986 | Keith et al. | 266/216 |
| 6,136,064 | A | * | 10/2000 | Newcomb | 266/901 |
| 2013/0161881 | A1 | * | 6/2013 | Lu | 266/44 |

* cited by examiner

*Primary Examiner* — Scott Kastler
(74) *Attorney, Agent, or Firm* — C. G. Mersereau; Nikolai & Mersereau, P.A.

(57) ABSTRACT

A metal melting apparatus has a heating furnace, a melting furnace mounted on the heating furnace, a high-cycle regenerative system (HRS), a raw material feeding device and a melted material feeding device mounted on the melting furnace. The HRS heats and recycles high temperature air in the heating furnace and guides the high temperature air to the preheating screw to preheat metal materials in the preheating screw. Thus, a time for melting the metal materials from solid to liquid is greatly shortened. Furthermore, a series of processes for preheating the metal materials in the raw material feeding device, melting the metal materials in the melting furnace and injecting the molten materials to the molds is fluent, time-saving and safe, and can progress continuously.

20 Claims, 3 Drawing Sheets

METAL MELTING APPARATUS AND METHOD FOR MELTING METAL

BACKGROUND OF THE INVENTION

1. Field of the Invention

The present invention relates to a metal melting apparatus and a method for melting metal that preheat metal granules or metal sheets with heat from the metal melting apparatus before heating and melting the granular metals or sheet metals.

2. Description of the Prior Art(s)

A conventional method for melting metal is to put metal materials, such as metal ingots, metal lumps, metal scraps and the like, into a furnace to heat the metal materials until they are melted. When the metal materials are melted into liquid and mixed, the molten metal materials are further injected into mold cavities of molds to form specific shapes.

However, before the metal materials, especially the metal ingots and the metal lumps, are put into the furnace to be heated, the metal materials are at an ordinary temperature so that melting the metal materials takes a long time. Moreover, since the temperature of the molten materials is very high, ladling the molten materials out of the furnace should be done very carefully no matter by manual or by automatic means in case accident happens. Furthermore, when ladling the molten materials, processes of heating and melting the metal materials have to stop. Operators are not able to go on putting the metal materials into the furnace until the molten materials are all injected into the mold cavities of the molds. Therefore, the conventional method for melting metal is disfluent, time consuming and laborious.

To overcome the shortcomings, the present invention provides a metal melting apparatus and a method for melting metal to mitigate or obviate the aforementioned problems.

SUMMARY OF THE INVENTION

The main objective of the present invention is to provide a metal melting apparatus and a method for melting metal. The metal melting apparatus has a heating furnace, a melting furnace mounted on the heating furnace, a high-cycle regenerative system (HRS), a raw material feeding device and a melted material feeding device mounted on the melting furnace.

The HRS heats and recycles high temperature air in the heating furnace and guides the high temperature air to the preheating screw to preheat metal materials in the preheating screw. Thus, a time for melting the metal materials from solid to liquid is greatly shortened. Furthermore, a series of processes for preheating the metal materials in the raw material feeding device, melting the metal materials in the melting furnace and injecting the molten materials to the molds is fluent, time-saving and safe, and can progress continuously.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
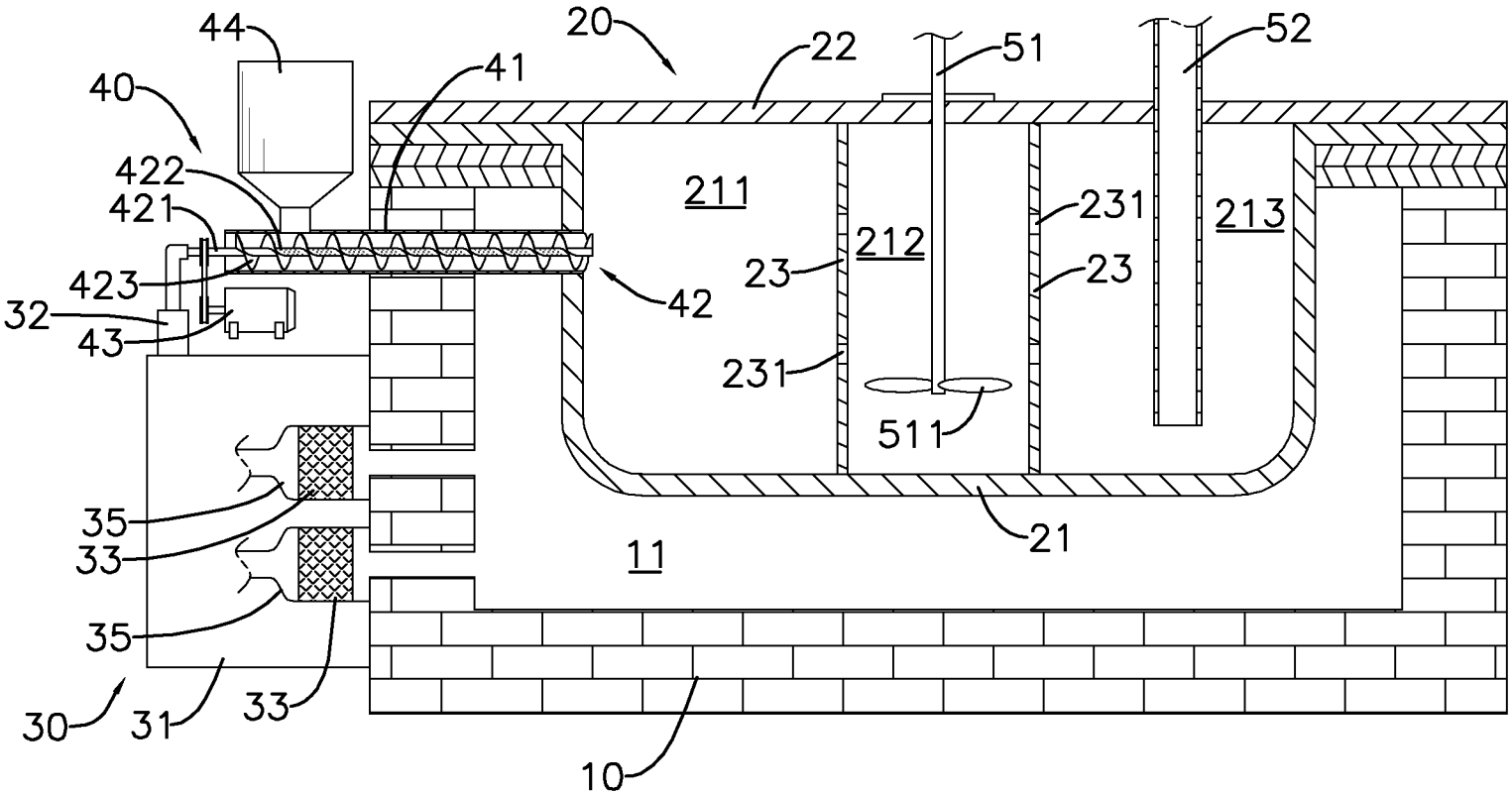
FIG. 1 is a conceptual side view of a first embodiment of a metal melting apparatus in accordance with the present invention.
Figure 2:
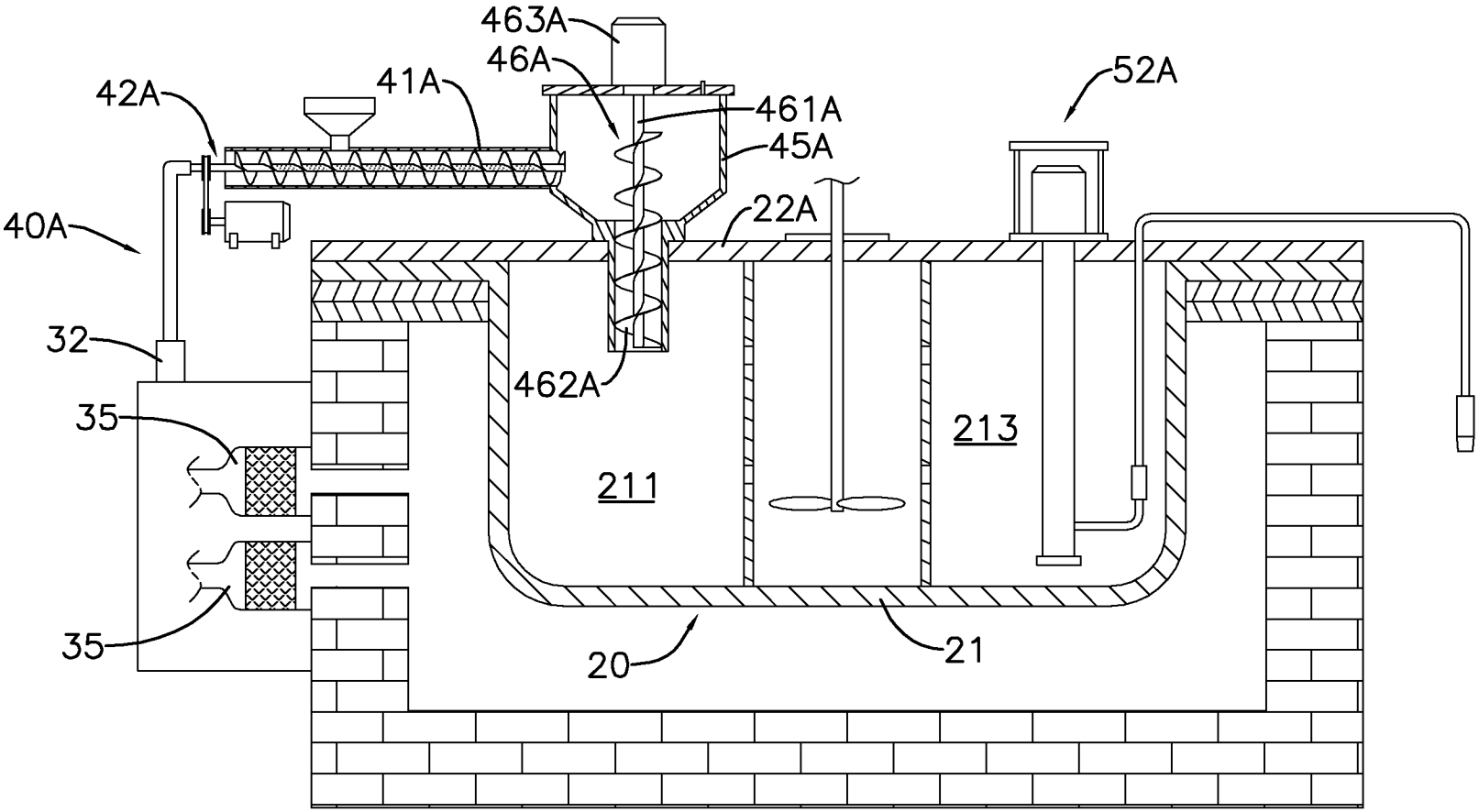
FIG. 2 is a conceptual side view of a second embodiment of a metal melting apparatus in accordance with the present invention.

With reference to FIGS. 1 and 2, a metal melting apparatus in accordance with the present invention comprises a heating furnace 10, a melting furnace 20, a high-cycle regenerative system (HRS) 30, a raw material feeding device 40, 40A, an agitator 51 and a melted material feeding device 52, 52A.

The heating furnace 10 has a heating room 11 formed in the heating furnace 10.

The melting furnace 20 is mounted on the heating furnace 10 and has a furnace body 21, two heat-resistant panels 23 and a cover 22, 22A. The furnace body 21 is mounted in the heating room 11 of the heating furnace 10 and has a top opening. The heat-resistant panels 23 are separately mounted in the furnace body 21 and divide the furnace body 21 into a melting zone 211, an agitating zone 212 and a feeding zone 213. Each heat-resistant panel 23 has multiple through holes 231 formed through the heat-resistant panel 23. The agitating zone 212 communicates with the melting zone 211. The feeding zone 213 communicates with the agitating zone 212 directly and with the melting zone 211 via the agitating zone 212.

Figure 3:
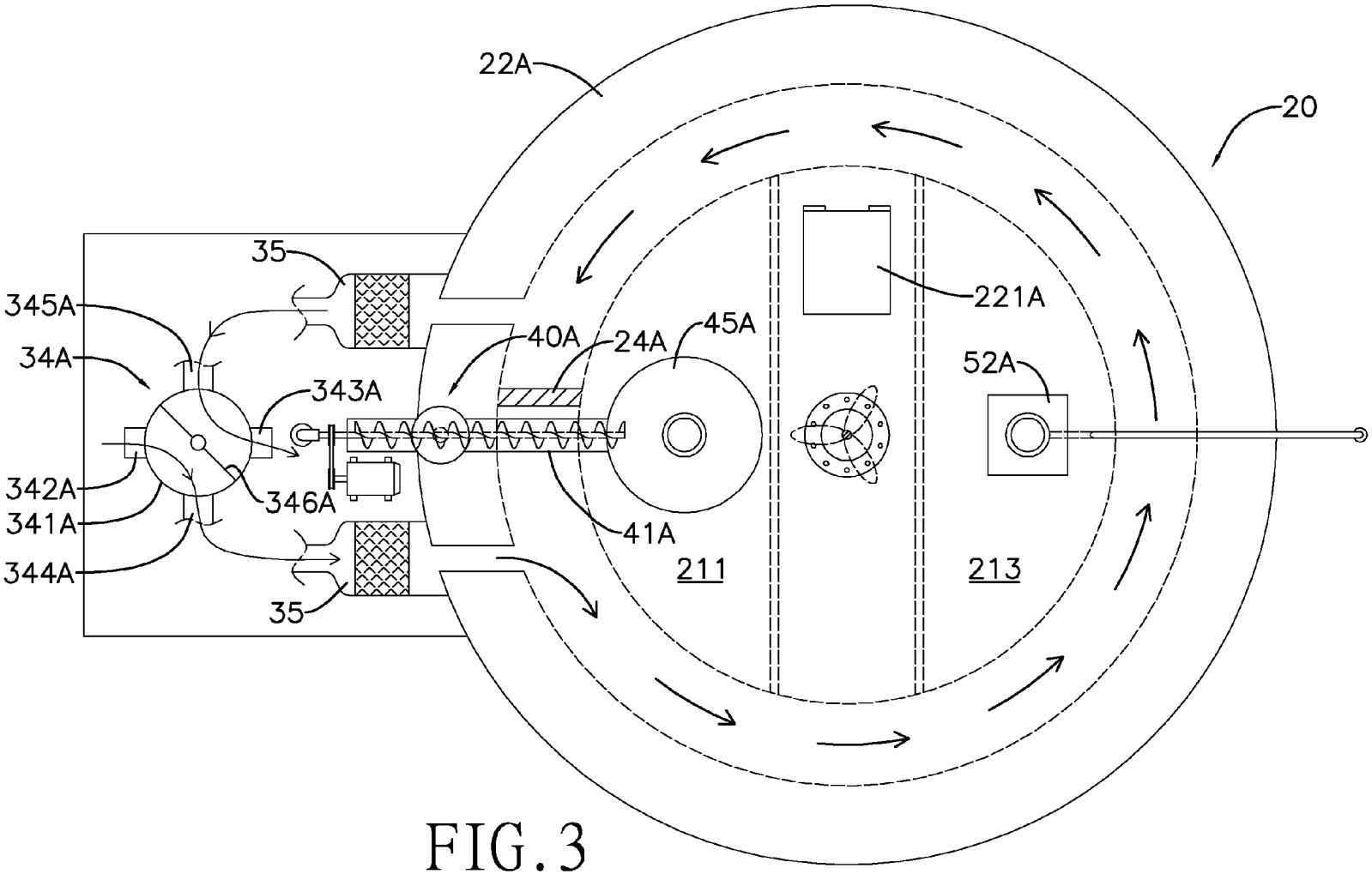
FIG. 3 is a conceptual top view of the metal melting apparatus in FIG. 2.

The cover 22, 22A is mounted on the top opening of the furnace body 21 and seals the furnace body 21. With further reference to FIG. 3, the cover 22A may have an opening formed through the cover 20A. The melting furnace 20 may further have a closing panel 221A mounted on the cover 22A and selectively covering the opening of the cover 22A. Thus, when the metal melting apparatus as described operates, the closing panel 221A covers the opening of the cover 22A and seals the furnace body 21. When the metal melting apparatus stops operating, the closing panel 221A is opened to allow operators to enter the furnace body 21 and clean molten slag off the furnace body 21.

The HRS 30 has a regenerative heat room 31, a pair of burners 35, a pair of regenerative heat exchanger units 33 and an air duct 32. The regenerative heat room 31 communicates with the heating room 11. The pair of burners 35 is mounted in the regenerative heat room 31 and heats the heating room 11 of the heating furnace 10 alternately to increase temperatures of the heating room 11 and the melting furnace 20. The pair of regenerative heat exchanger units 33 is respectively mounted on the pair of burners 35. As one burner 35 heats the heating room 11, high temperature air in the heating room 11 discharges through the other burner 35 and transfers heat to a corresponding regenerative heat exchanger unit 33. Since the high temperature air preheats the regenerative heat exchanger units 33 on the burners 35, heating capabilities of the burners 35 are improved.

The air duct 32 of the HRS 30 has an inlet and an outlet. The inlet of the air duct 32 of the HRS 30 is connected to and communicates with the pair of burners 35, and guides the high temperature air around the pair of regenerative heat exchanger units 33 into the air duct 32. The outlet of the air duct 32 of the HRS 30 protrudes out of the regenerative heat room 31.

Preferably, with reference to FIG. 3, the HRS 30 may further have a switch valve 34A. The switch valve 34A is a four-way valve and has a housing 341A and a rotating partition 346A. The housing 341A has an inlet 342A, an outlet 343A, a first passage 344A and a second passage 345A. The outlet 343A of the housing 341A is disposed opposite to the inlet 342A of the housing 341A, and is connected to and communicates with the air duct 32 of the HRS 30. The first passage 344A of the housing 341A is connected to and communicates with one of the pair of burners 35. The second passage 345A of the housing 341A is disposed opposite to the first passage 344A of the housing 341A, and is connected to and communicates with the other one of the pair of burners 35. The rotating partition 346A is rotatably mounted in the housing 341A and divides the housing 341A into two separate rooms so the first passage 344A alternately communicates with the inlet 342A of the housing 341A as the second passage 345A communicates with the outlet 343A of the housing 341A, and communicates with the outlet 343A of the housing 341A as the second passage 345A communicates with the inlet 342A of the housing 341A.

The raw material feeding device 40, 40A has a feed pipe 41, 41A, a preheating screw 42, 42A and a feeding hopper 44. The feed pipe 41, 41A has an outlet communicating with the melting zone 211 of the furnace body 21. The preheating screw 42, 42A is axially mounted through the feed pipe 41, 41A and has an air duct 421 and a helical blade 423. The air duct 421 of the preheating screw 42, 42A is rotatably mounted through the feed pipe 41, 41A, is driven by a driving assembly 43 and has multiple air holes 422 and an inlet. The air holes 422 are separately formed through the air duct 421 of the preheating screw 42, 42A. The inlet of the air duct 421 of the preheating screw 42, 42A is connected to and communicates with the outlet of the air duct 32 of the HRS 30 so the high temperature air in the air duct 32 of the HRS 30 further flows into the air duct 421 of the preheating screw 42. The helical blade 423 of the preheating screw 42, 42A is formed around an outer surface of the air duct 421 of the preheating screw 42, 42A and extends axially along the air duct 421 of the preheating screw 42, 42A. The feeding hopper 44 is mounted on the feed pipe 41, 41A, and is connected to and communicates with an interior of the feed pipe 41, 41A.

The agitator 51 is rotatably mounted on the cover 22, 22A of the melting furnace 20, corresponds to the agitating zone 212 of the furnace body 21 and has an inner end and a stirring blade 511. The inner end of the agitator 51 protrudes into the agitating zone 212. The stirring blade 511 is mounted on the inner end of the agitator 51.

The melted material feeding device 52, 52A is mounted on the cover 22, 22A of the melting furnace 20, corresponds to and protrudes into the feeding zone 213 of the furnace body 21, draws molten metal materials in the furnace body 21 and injects the molten metal to molds that are used for casting metal products.

With reference to FIG. 1, the melted material feeding device 52 is a tube and has an inlet protruding in the furnace body 21.

With reference to FIG. 2, the melted material feeding device 52A is a molten metal pump.

When the metal melting apparatus operates, metal materials, such as metal granules and metal sheets, are put in the feeding hopper 44 of the raw material feeding device 40, 40A and slide into the feed pipe 41, 41A. The driving assembly 43 rotates the preheating screw 42, 42A so the helical blade 423 of the preheating screw 42, 42A pushes the metal materials toward the outlet of the feed pipe 41, 41A. Meanwhile, the high temperature air in the air duct 32 of the HRS 30 further flows into the air duct 421 of the preheating screw 42, 42A and the feed pipe 41, 41A via the air holes 422 of the air duct 421 of the preheating screw 42, 42A to heat the metal materials in the feed pipe 41, 41A. Since the helical blade 423 of the preheating screw 42, 42A also mixes the metal materials in the feed pipe 41, 41A, the metal materials are heated uniformly and fully, change from solid to semi-solid, and get into the melting zone 211 of the furnace body 21.

After the semi-solid metal materials get into the melting zone 211 of the furnace body 21, heat of the melting furnace 20 further melts the semi-solid metal materials into liquid.

Then, the molten metal materials flow into the agitating zone 212 of the furnace body 21 via the through holes 231 of the heat-resistant panel 23 that is disposed between the melting zone 211 and the agitating zone 212. The agitator 51 rotates to agitate the molten metal materials and mix the molten metal materials well.

Afterwards, the molten metal materials further flow into the feeding zone 213 of the furnace body 21 via the through holes 231 of the heat-resistant panel 23 that is disposed between the agitating zone 212 and the feeding zone 213.

As the preheating screw 42, 42A of the raw material feeding device 40, 40A rotates and continues to push the metal materials into the melting zone 211 of the furnace body 21, the molten metal materials in the furnace body 21 are pressed. Consequently, the molten metal materials in the feeding zone 213 of the furnace body 21 further flow into the melted material feeding device 52, 52A and then are injected into the molds. Moreover, as speeds of the preheating screw 42, 42A are regulated, injection speeds and quantities of the melted material feeding device 52, 52A are also regulated.

Preferably, with reference to FIG. 3, the metal melting apparatus may further have a dividing partition 24A. The dividing partition 24A is mounted in the heating room 11 of the heating furnace 10, is disposed between the pair of burners 35 and has two side edges respectively abutting an inner surface of the heating furnace 10 and an outer surface of the furnace body 21.

Thus, when the rotating partition 346A of the switch valve 34A rotates until the first passage 344A communicates with the inlet 342A of the housing 341A and the second passage 345A communicates with the outlet 343A of the housing 341A, combustion air flows into the housing 341A via the inlet 342A of the housing 341A and into one of the pair of burners 35 via the first passage 344A, and is heated by the burner 35 to become high temperature air. Then, the high temperature air further flows into the heating room 11 of the heating furnace 10 to provide and transfer heat to the furnace body 21. Afterwards, the high temperature air flows out of the heating room 11 via the other one of the pair of burners 35, and flows through the second passage 345A and the outlet 343A of the housing 341A and into the air duct 32 of the HRS 30.

The dividing partition 24A ensures that the high temperature air derived from one of the pair of burners 35 would flow out via the other one of the pair of burners 35 only when the high temperature air flows throughout the heating room 11.

With reference to FIG. 1, the feed pipe 41 may be transversely mounted through the heating furnace 10 and the furnace body 21 and the outlet of the feed pipe 41 protrude into the melting zone 211 of the furnace body 21.

With reference to FIG. 2, the feed pipe 41A and the preheating screw 42A may be mounted above the cover 22A of the melting furnace 20. The raw material feeding device 40A may further have a charging hopper 45A and a measuring screw 46A. The charging hopper 45A is mounted on and through the cover 22A of the melting furnace 20, corresponds to the melting zone 211 of the furnace body 21, protruding into the furnace body 21 and is connected to and communicates with the outlet of the feed pipe 41A. Thus, the preheating screw 42A pushes the preheated semi-solid metal materials into the charging hopper 45A.

The measuring screw 46A is longitudinally mounted on the charging hopper 45A and has a rod 461A and a helical blade 462A. The rod 461A is rotatably mounted through the charging hopper 45A and is driven by a driving device 463A. The helical blade 462A of the measuring screw 46A is formed around the rod 461A. As the measuring screw 46A rotates, the helical blade 462A of the measuring screw 46A pushes the metal materials in the charging hopper 45A into the melting zone 211 of the furnace body 21. Moreover, since the charging hopper 45A communicates with the melting zone 211 of the furnace body 21, the heat in the melting zone 211 of the furnace body 21 also transfers to the charging hopper 45A to heat the metal materials in the charging hopper 45A. As speeds of the measuring screw 46A are regulated, injection quantities of the metal materials in the charging hopper 45A to the melting zone 211 are also regulated.

The metal melting apparatus and the method for melting metal as described have the following advantages. The HRS 30 recycles the high temperature air in the heating furnace 10 and guides the high temperature air into the preheating screw 42, 42A to preheat the metal materials, such as the metal granules and the metal sheets, in the preheating screw 42, 42A. Thus, a time for melting the metal materials from solid to liquid is greatly shortened. Furthermore, since the metal melting apparatus does not have to stop to allow the operator to pour or ladle the molten materials, a series of processes for preheating the metal materials in the raw material feeding device 40, 40A, melting the metal materials in the melting furnace 20 and injecting the molten materials to the molds to cast metal products is fluent, time-saving and safe, and can progress continuously.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A metal melting apparatus comprising:
- a heating furnace having a heating room;
- a melting furnace mounted on the heating furnace and having
  - a furnace body mounted in the heating room of the heating furnace and having a top opening; and
  - a cover mounted on the top opening of the furnace body and sealing the furnace body;
- a high-cycle regenerative system (HRS) having
  - a regenerative heat room communicating with the heating room;
  - a pair of burners mounted in the regenerative heat room and heating the heating room of the heating furnace alternately;
  - a pair of regenerative heat exchanger units respectively mounted on the pair of burners; and
  - an air duct having
    - an inlet connected to and communicating with the pair of burners; and
    - an outlet protruding out of the regenerative heat room;
- a raw material feeding device having
  - feed pipe having an outlet communicating with the furnace body;
  - a preheating screw axially mounted through the feed pipe and having
    - an air duct rotatably mounted through the feed pipe and having
      - multiple air holes separately formed through the air duct of the preheating screw; and
      - an inlet connected to and communicating with the outlet of the air duct of the HRS; and
    - a helical blade formed around an outer surface of the air duct of the preheating screw; and
  - a feeding hopper mounted on the feed pipe, and connected to and communicating with an interior of the feed pipe; and
- a melted material feeding device mounted on the cover of the melting furnace and protruding into the furnace body.

2. The metal melting apparatus as claimed in claim 1, wherein
- the feed pipe of the raw material feeding device is transversely mounted through the heating furnace and the furnace body; and
- the outlet of the feed pipe protrudes into the furnace body.

3. The metal melting apparatus as claimed in claim 1, wherein
- the feed pipe and the preheating screw of the raw material feeding device are mounted above the cover of the melting furnace; and
- the raw material feeding device further has
  - a charging hopper mounted on and through the cover of the melting furnace, protruding into the furnace body, and connected to and communicating with the outlet of the feed pipe; and
  - a measuring screw longitudinally mounted on the charging hopper and having
    - a rod rotatably mounted through the charging hopper; and
    - a helical blade formed around the rod.

4. The metal melting apparatus as claimed in claim 1, wherein the melted material feeding device is a tube and has an inlet protruding in the furnace body.

5. The metal melting apparatus as claimed in claim 2, wherein the melted material feeding device is a tube and has an inlet protruding in the furnace body.

6. The metal melting apparatus as claimed in claim 3, wherein the melted material feeding device is a tube and has an inlet protruding in the furnace body.

7. The metal melting apparatus as claimed in claim 1, wherein the melted material feeding device is a molten metal pump.

8. The metal melting apparatus as claimed in claim 2, wherein the melted material feeding device is a molten metal pump.

9. The metal melting apparatus as claimed in claim 3, wherein the melted material feeding device is a molten metal pump.

10. The metal melting apparatus as claimed in claim 1, wherein
- the melting furnace further has two heat-resistant panels separately mounted in the furnace body and dividing the furnace body into a melting zone,
- an agitating zone and a feeding zone, each heat-resistant panel having multiple through holes formed through the heat-resistant panel, the agitating zone communicating with the melting zone, and the feeding zone communicating with the agitating zone directly and with the melting zone via the agitating zone; and the metal melting apparatus further comprises an agitator rotatably mounted on the cover of the melting furnace, corresponding to the agitating zone of the furnace body and having an inner end protruding into the agitating zone; and a stirring blade mounted on the inner end of the agitator.

11. The metal melting apparatus as claimed in claim 2, wherein the melting furnace further has two heat-resistant panels separately mounted in the furnace body and dividing the furnace body into a melting zone, an agitating zone and a feeding zone, each heat-resistant panel having multiple through holes formed through the heat-resistant panel, the agitating zone communicating with the melting zone, and the feeding zone communicating with the agitating zone directly and with the melting zone via the agitating zone; and the metal melting apparatus further comprises an agitator rotatably mounted on the cover of the melting furnace, corresponding to the agitating zone of the furnace body and having an inner end protruding into the agitating zone; and a stirring blade mounted on the inner end of the agitator.

12. The metal melting apparatus as claimed in claim 3, wherein the melting furnace further has two heat-resistant panels separately mounted in the furnace body and dividing the furnace body into a melting zone, an agitating zone and a feeding zone, each heat-resistant panel having multiple through holes formed through the heat-resistant panel, the agitating zone communicating with the melting zone, and the feeding zone communicating with the agitating zone directly and with the melting zone via the agitating zone; and the metal melting apparatus further comprises an agitator rotatably mounted on the cover of the melting furnace, corresponding to the agitating zone of the furnace body and having an inner end protruding into the agitating zone; and a stirring blade mounted on the inner end of the agitator.

13. The metal melting apparatus as claimed in claim 10, wherein the cover of the melting furnace has an opening formed through the cover; and the melting furnace further has a closing panel mounted on the cover and selectively covering the opening of the cover.

14. The metal melting apparatus as claimed in claim 11, wherein the cover of the melting furnace has an opening formed through the cover; and the melting furnace further has a closing panel mounted on the cover and selectively covering the opening of the cover.

15. The metal melting apparatus as claimed in claim 12, wherein the cover of the melting furnace has an opening formed through the cover; and the melting furnace further has a closing panel mounted on the cover and selectively covering the opening of the cover.

16. The metal melting apparatus as claimed in claim 13, wherein the HRS further has a switch valve having a housing having an inlet;

an outlet disposed opposite to the inlet of the housing, and connected to and communicating with the air duct of the HRS;

a first passage connected to and communicating with one of the pair of burners; and a second passage disposed opposite to the first passage of the housing, and connected to and communicating with the other one of the pair of burners; and a rotating partition rotatably mounted in the housing and dividing the housing into two separate rooms.

17. The metal melting apparatus as claimed in claim 14, wherein the HRS further has a switch valve having a housing having an inlet;

an outlet disposed opposite to the inlet of the housing, and connected to and communicating with the air duct of the HRS;

a first passage connected to and communicating with one of the pair of burners; and a second passage disposed opposite to the first passage of the housing, and connected to and communicating with the other one of the pair of burners; and a rotating partition rotatably mounted in the housing and dividing the housing into two separate rooms.

18. The metal melting apparatus as claimed in claim 15, wherein the HRS further has a switch valve having a housing having an inlet;

an outlet disposed opposite to the inlet of the housing, and connected to and communicating with the air duct of the HRS;

a first passage connected to and communicating with one of the pair of burners; and a second passage disposed opposite to the first passage of the housing, and connected to and communicating with the other one of the pair of burners; and a rotating partition rotatably mounted in the housing and dividing the housing into two separate rooms.

19. The metal melting apparatus as claimed in claim 16 further comprising a dividing partition mounted in the heating room of the heating furnace, disposed between the pair of burners and having two side edges respectively abutting an inner surface of the heating furnace and an outer surface of the furnace body.

20. A method for melting metal in a metal melting apparatus comprising:

a heating furnace having a heating room;

a melting furnace mounted on the heating furnace and having a furnace body mounted in the heating room of the heating furnace and having a top opening; and a cover mounted on the top opening of the furnace body and sealing the furnace body;

a high-cycle regenerative system (HRS) having a regenerative heat room communicating with the heating room;

a pair of burners mounted in the regenerative heat room and heating the heating room of the heating furnace alternately;

a pair of regenerative heat exchanger units respectively mounted on the pair of burners; and an air duct having an inlet connected to and communicating with the pair of burners; and an outlet protruding out of the regenerative heat room;

a raw material feeding device having a feed pipe having an outlet communicating with the furnace body;

a preheating screw axially mounted through the feed pipe and having an air duct rotatably mounted through the feed pipe and having multiple air holes separately formed through the air duct of the preheating screw; and an inlet connected to and communicating with the outlet of the air duct of the HRS; and a helical blade formed around an outer surface of the air duct of the preheating screw; and a feeding hopper mounted on the feed pipe, and connected to and communicating with an interior of the feed pipe; and a melted material feeding device mounted on the cover of the melting furnace and protruding into the furnace body, wherein the method comprises steps of:

guiding high temperature air from the heating room of the heating furnace via the air duct of the HRS to the regenerative heat room and the air duct of the preheating screw of the raw material feeding device to heat metal materials in the feed pipe; and pushing the metal materials via the preheating screw into the furnace body of the melting furnace to melt the metal materials into liquid.

* * * * *